United States Patent [19]

Levenberg

[11] Patent Number: 4,664,040

[45] Date of Patent: May 12, 1987

[54] DESK ORGANIZER

[75] Inventor: Nat Levenberg, Lynbrook, N.Y.

[73] Assignee: Jefsteel Business Equipment Corp., Brooklyn, N.Y.

[21] Appl. No.: 844,525

[22] Filed: Mar. 27, 1986

[51] Int. Cl.[4] ..... A47B 47/02

[52] U.S. Cl. ..... 108/111; 211/187; 211/135; 108/109

[58] Field of Search ..... 108/111, 60, 109, 110; 211/184, 186, 187, 135

[56] References Cited

U.S. PATENT DOCUMENTS

| | | | |
|---|---|---|---|
| 435,877 | 9/1890 | Yawman | 108/60 |
| 915,618 | 3/1909 | Mattison | 108/111 |
| 1,195,374 | 8/1916 | Look | 108/111 |
| 2,932,343 | 4/1960 | la Brut | 108/111 X |
| 3,464,372 | 9/1969 | Fiterman et al. | 108/111 X |
| 4,233,912 | 11/1980 | Ferdinand | 108/109 |
| 4,236,460 | 12/1980 | Poupko | 108/111 X |
| 4,469,231 | 9/1984 | Hehn | 108/111 X |

FOREIGN PATENT DOCUMENTS

| | | | |
|---|---|---|---|
| 189911 | 12/1922 | United Kingdom | 211/135 |

*Primary Examiner*—Peter A. Aschenbrenner
*Attorney, Agent, or Firm*—Charles E. Temko

[57] ABSTRACT

A sheet metal folding shelf construction particularly suited for desk top use which may be transported in partially assembled folded condition to be subsequently erected by a user with a minimum of manipulation. A back panel is hingedly interconnected at each end to a pair of side panels, the side panels defining slots in which shelf members are engaged, the engagement of the shelf members serving to inhibit axial movement of the hinged components on the back and side elements.

3 Claims, 12 Drawing Figures

DESK ORGANIZER

BACKGROUND OF THE INVENTION

This invention relates generally to the field of storage shelving, and more particularly to an improved form of shelving unit commonly known as a desk organizer, which is a small shelf unit adapted to be supported on a horizontal surface of a desk to increase the effective area thereof by supporting various objects in superimposed relation. Devices of this general type are well known in the art, and the invention lies in specific constructional details which permit shipment of the device in such manner that the likelihood of damage is substantially eliminated, and in which erection and assembly of the device by the user is materially simplified.

Prior art devices, most commonly manufactured from sheet metal panels have been shipped in fully assembled condition in fibrous containers. Since the device itself is substantially hollow and possesses considerable flexibility under stress, using normal transportation facilities, a degree of damage to a substantial percentage of units shipped may be expected. Often the damage is relatively slight, and easily corrected. The appearance of the device, once damaged is permanently degraded, and the user is thus reluctant to put a damaged unit into service.

Where it is possible to ship the device in fully collapsed condition, the parts thereof are placed in parallel juxtaposed position within a container to result in an increased rigidity. This is, however, at the cost of added complexity during assembly, which is an undesired concomitant.

SUMMARY OF THE INVENTION

Briefly stated, the invention contemplates the provision of an improved shelving construction of the type described, in which certain of the component parts are hingedly interconnected prior to shipment to enable them to be placed in generally planar condition for shipping, and in which other components are shipped in disconnected relation, the disconnected parts being assembled with the first mentioned parts upon partial erection of the remaining parts to impart rigidity to the remaining structure using relatively few screws or similar interconnecting devices. The partially assembled components of the device may thus be shipped in generally planar condition with substantial ability to resist damage, and lower shipping costs, it requiring only minimum manipulation on the part of the user to bring the device to fully operative configuration.

BRIEF DESCRIPTION OF THE DRAWINGS

In the drawings, to which reference will be made in the specification, similar reference characters have been employed to designate corresponding parts throughout the several views.

DETAILED DESCRIPTION OF THE ENCLOSED EMBODIMENT

Figure 1:
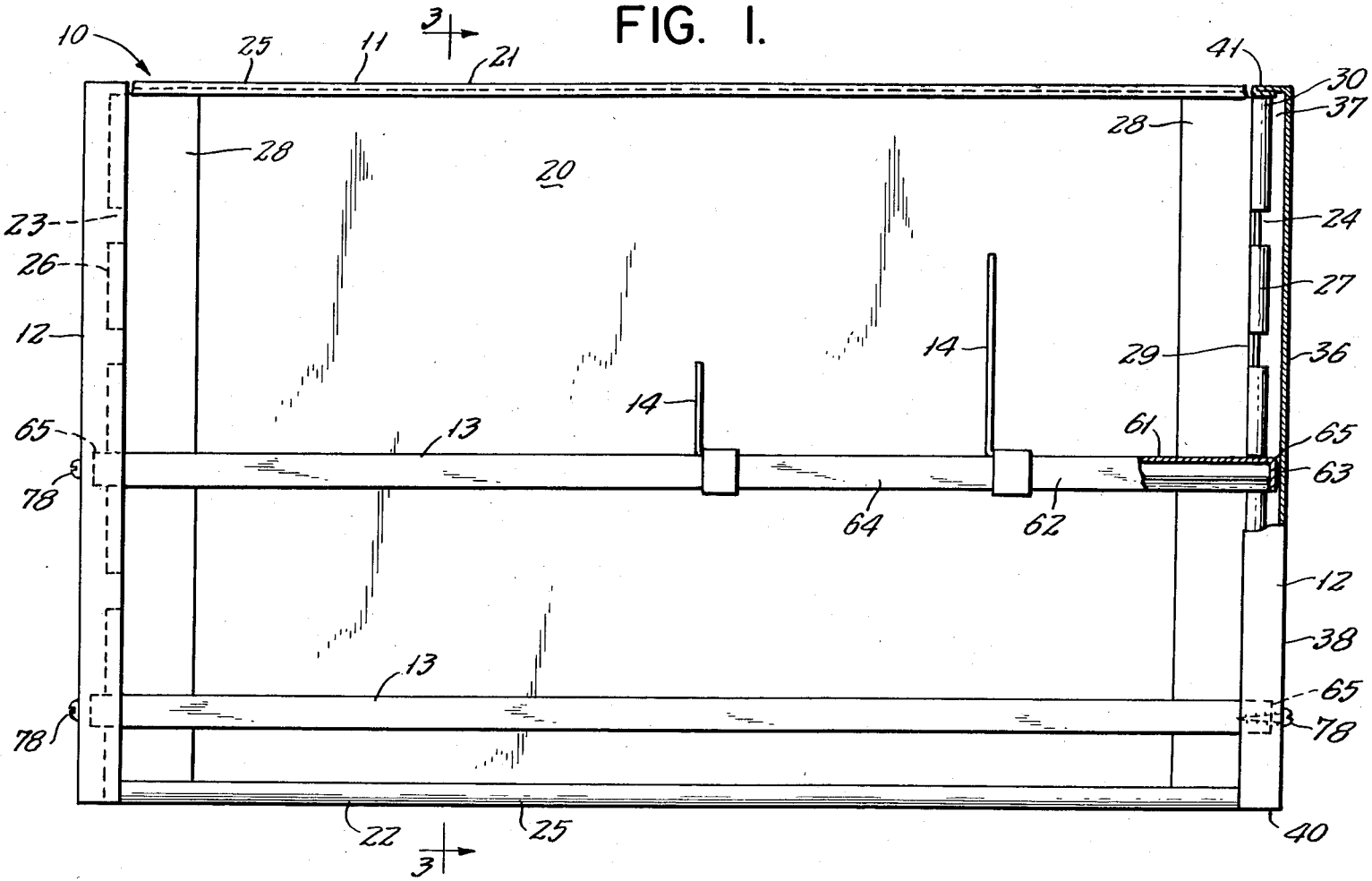
FIG. 1 is a front elevational view of an embodiment of the invention.
Figure 4:
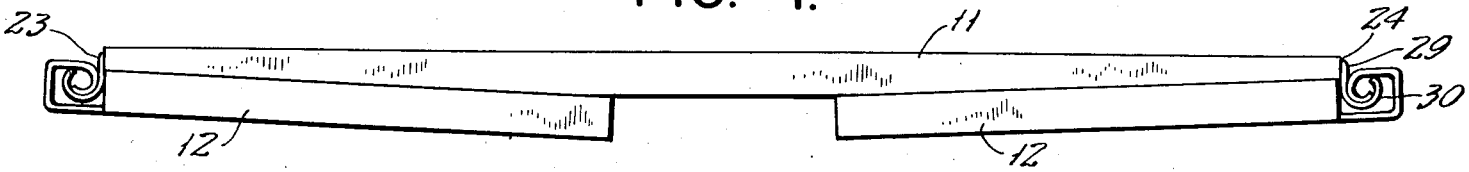
FIG. 4 is a fragmentary top plan view thereof, showing the device in collapsed condition, and prior to full assembly.
Figure 2:
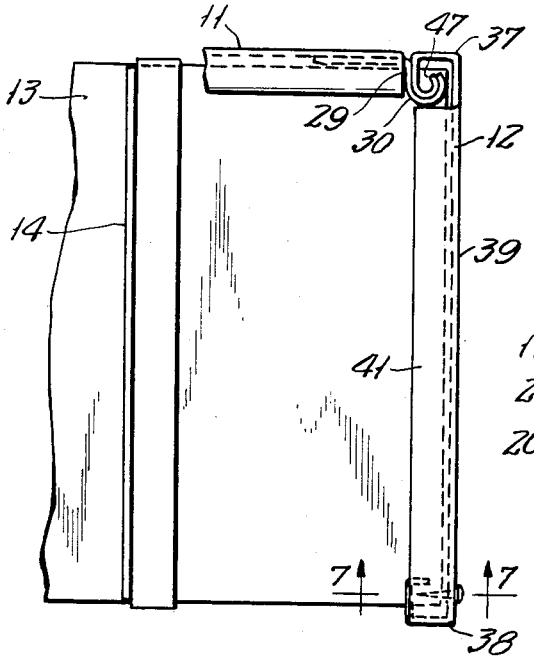
FIG. 2 is a fragmentary top plan view thereof.
Figure 5:
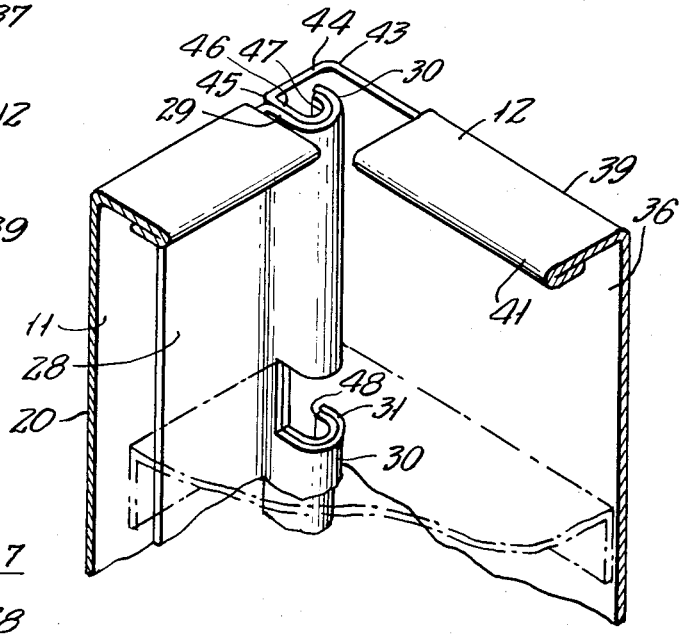
FIG. 5 is a fragmentary view in perspective thereof.
Figure 3:
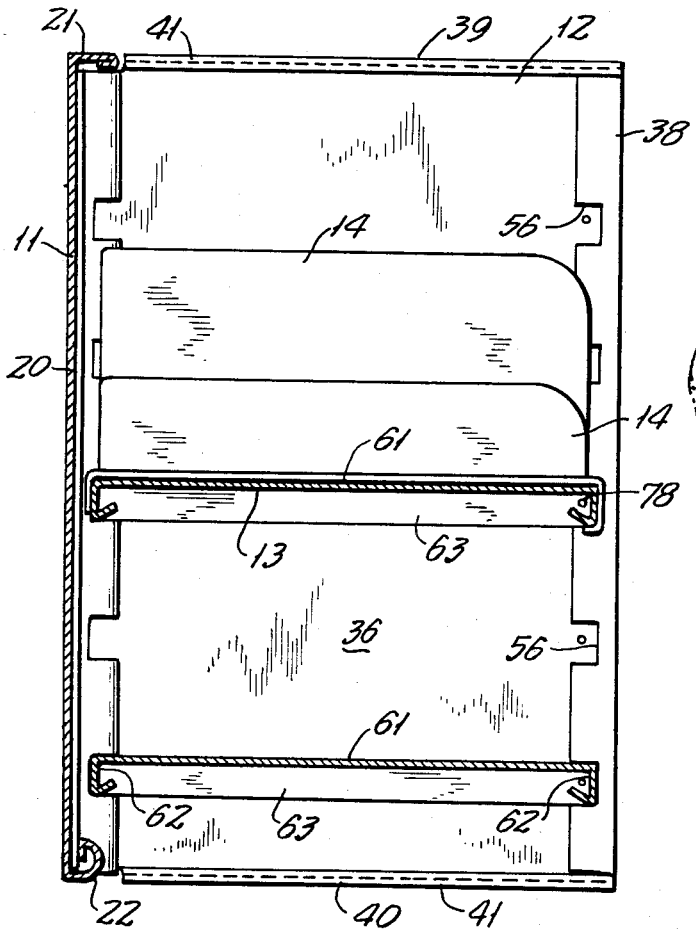
FIG. 3 is a transverse vertical sectional view thereof as seen from the plane 3—3 in FIG. 1.
Figure 6:
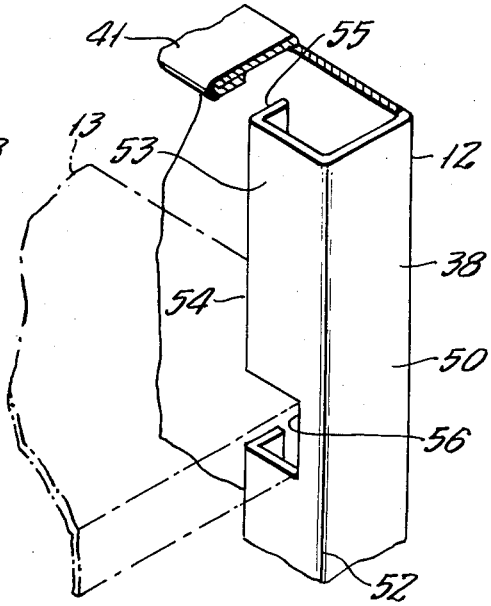
FIG. 6 is a second fragmentary view in perspetive, partly broken away to show detail.
Figure 7:
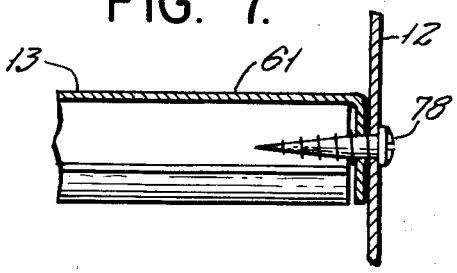
FIG. 7 is a fragmentary vertical sectional view as seen from the plane 7—7 in FIG. 1.

In accordance with the invention, the device, generally indicated by reference character 10, comprises broadly: a rear wall element 11, a pair of side wall elements 12, a plurality of shelf elements 13, and optional dividing means 14.

The rear wall element 11, as is mentioned, is formed from stamped sheet metallic material, and includes a generally planar rear wall member 20 bounded by first and second longer edges 21 and 22, respectively, as well as first and second relatively shorter edges 23 and 24, respectively. The longer edges 21–22 support angularly disposed reinforcing flanges 25. The shorter edges 23 and 24 support first and second hinge members 26 and 27, respectively, each including a mounting plate 28 welded to the inner surface of the wall member 20, and laterally extending flanges 29 communicating with curled portions 30 which are separated by shelf-engaging slots 31. The portions 30 form one part of a pair of hinge means by which the rear wall element is interconnected with the side wall elements 12.

The side wall elements 12 are also formed as sheet metal stampings, each including a rectangular wall member 36 bounded by first and second longer edges 37 and 38 and first and second shorter side edges 39 and 40. Corresponding angularly disposed reinforcing flanges 41 impart rigidity at the shorter edges. The longer side edges, at one side thereof support flange members 43, including a first portion 44 thereof interconnected at a fold edge 45 to a second portion 46 thereof in turn leading to segmented curled portions 47 which form a second part of interconnecting hinge means. The curled portions 47 include shelf engaging slots 48 which, when the curled portions are assembled, are aligned with the slots 31. At the non-hinged longer side edges of the side wall elements is a reinforcing flange 50, including a first portion 51, interconnected at a fold line 52 to a second portion 53, the portion 53 having a fold edge 54 supporting a third portion 55. The portions 53 and 55 are also provided with shelf engaging slots which are in coplanar relation with respect to the slots 31 and 48.

The shelf elements 13 are substantially similar, and accordingly, a description of one will serve to describe all. These may be formed as relatively solid planks, but are preferably formed from sheet metal as is the case in the elements 11 and 12. Each shelf includes a main horizontal wall 61 of rectangular configuration, and supporting at the edges thereof longer reinforcing flanges 62 and shorter reinforcing flanges 63 at the edges 64 and 65, respectively. The width of the flanges 62 and 63 correspond to the width of the above mentioned slots so as to provide rigidity upon assembly.

Normally the device 10 will be shipped with the elements 11 and 12 in pivotally assembled condition, and folded to generally flattened condition. The shelf elements 13 may be wrapped in protective material and placed in juxtaposed mutually parallel relation prior to insertion into a shipping carton (not shown).

Upon arrival at the premises of the user, the parts are unpacked, and assembly commenced by outwardly folding the side wall elements 12 with respect to the rear wall elements 11 to approximately a 90 degree angle. Next, one or more shelf elements 13 are inserted between the side wall elements such that the areas adjacent the shorter edges thereof are aligned in the slots 39, 48 and 56. Next, screws 78 are inserted through corresponding holes in the plane of the side walls and the shelves, only at the outer corners adjacent the slots 36. This completes the assembly, and results in the necessary rigidity to support the device.

Optional divider means 14 may then be snapped into position on the upper surface of each of the shelf elements 13 in well known manner. It will be observed that since the inner corners of the shelf elements engage both the slots 31 and the slots 48, the curled portions forming the hinge means on the rear and side wall elements are axially locked, thus preventing any tendency of the device to disengage at the respective corners.

Turning now to the modified form of the embodiment shown in FIGS. 8 to 12 inclusive, parts corresponding to those of the principal form have been designated by similar reference characters with the additional prefix "I".

The modified form of the embodiment differs from the principal form thereof in the provision of means whereby the shelves may be of a length which is less than that of the rear wall element, thus permiting accommodation for objects the effective height of which is greater than the distance between normally positioned adjacent shelves. Typical of such objects would be the cathode ray tube display of a computer or computer terminal.

Figures 8, 9, 10, 11, 12:
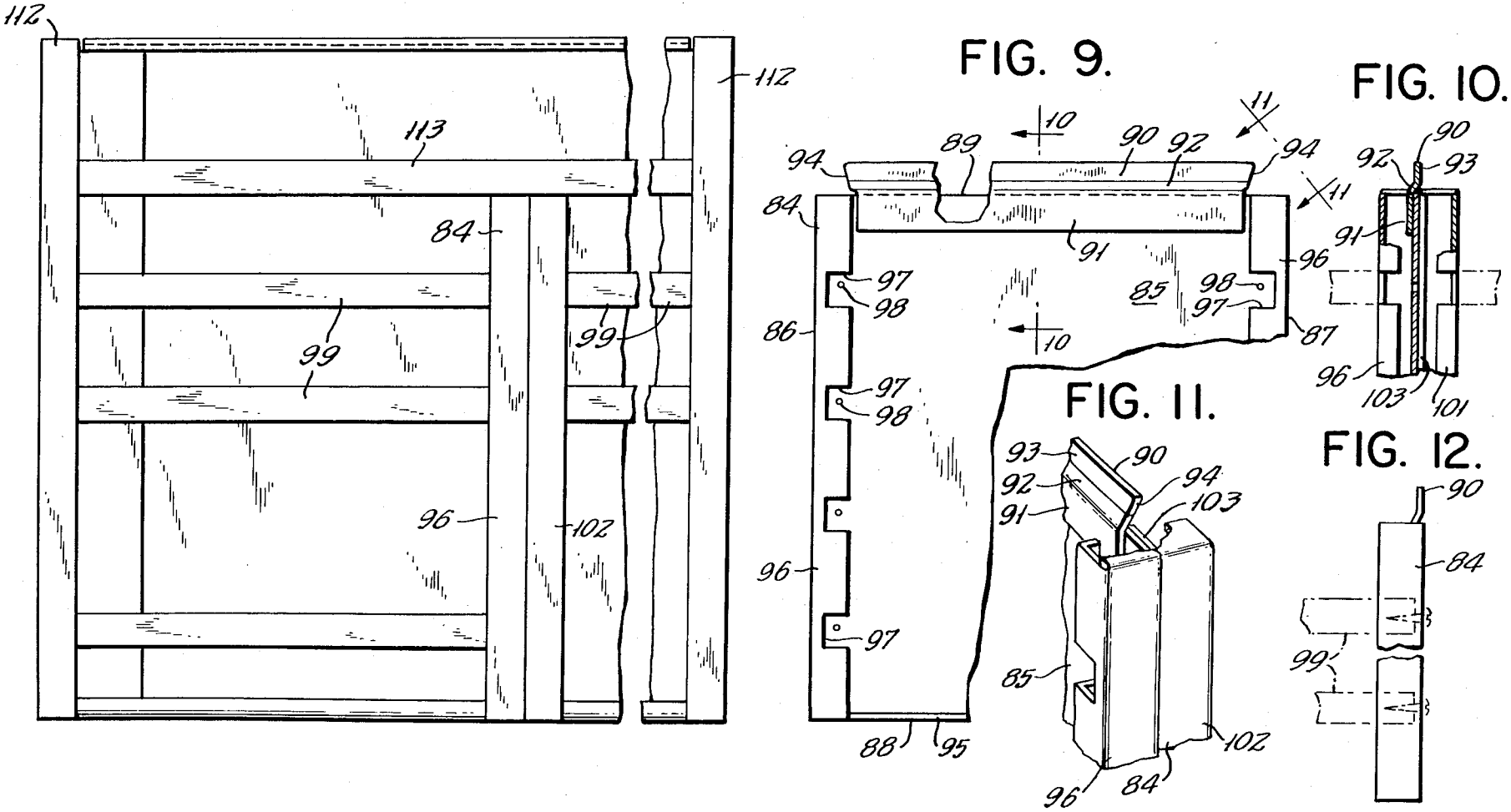
FIG. 8 is a fragmentary front elevational view of an alternate form of the embodiment.
FIG. 9 is a fragmentary side elevational view of an intermediate wall forming a part of the modified form of the embodiment.
FIG. 10 is a fragmentary vertical sectional view as seen from the plane 10—10 in FIG. 9.
FIG. 11 is a fragmentary view in perspective corresponding to the upper left hand portion of FIG. 9.
FIG. 12 is a fragmentary end elevational view of the embodiment.

To this end, there is provided an intermediate vertical wall element 84 which is adapted to be positioned between the side wall elements 112 which may support one end of an individual short shelf 99 on either side thereof as shown in FIG. 11, or on a single side thereof as shown in FIG. 12.

The construction of the vertical wall element 84 is generally similar to that of the side wall elements 112, and includes a main planar panel 85 bounded by vertical side edges 86 and 87, a lower edge 88 and an upper edge 89. At the upper edge 89 is a positioning flange member 90 including a lower portion 91, an offset portion 92, and an upper portion 93 having undercut terminals 94 to permit engagement with a full length shelf 113 positioned immediately thereabove.

At the lower edge 88 is an integral bottom flange 95. Integral side flanges 96 are provided with slotted shelf engaging openings 97 and corresponding screw holes 98 for maintaining shorter shelves 99.

To enable the attachment of shelves on either side of the wall 84, there are provided additional side flanges 101 and 102, each including a welded base member 103. In the version shown in FIG. 12, this structure is eliminated where shorter shelves are desired on only one side of the intermediate vertical wall 84.

I wish it to be understood that I do not consider the invention to be limited to the precise details of the structure shown and set forth in this specification, for obvious modifications will occur to those skilled in the art to which the invention pertains.

I claim:

1. Improved sheet metal shelf construction comprising: a rear wall element including a sheet metal main planar panel having opposed end edges, first segmented hinge means formed of curled sheet metal at said end edges defining shelf-engaging slots therein; first and second sheet metal side wall elements each including a main planar panel having opposed end edges, corresponding second segmented hinge means formed of curled sheet metal at one of said end edges defining shelf-engaging slots therein, said first and second hinge means being axially slidably mutually engageable, one within the other to provide relative pivotal movement therebetween; said side wall elements having flange means at the other of said end edges thereof, having shelf-engaging slots in coplanar relation relative to said slots in said hinge means; at least one rectangularly shaped shelf selectively engaged within coplanar slots in said rear and side wall elements, engagement of the shelf in the shelf engaging slots serving to prevent relative axial movement between said first and second engaged hinge means; and means penetrating said side wall elements and said shelf to maintain said shelf in engagement within said coplanar slots.

2. Improved sheet metal shelf construction in accordance with claim 1, further comprising: at least one intermediate vertical wall element positioned beneath said shelf element and between said first and second side wall elements; said intermediate side wall element being of an effective height corresponding to the vertical distance between said shelf element and horizontal lower edges of said side wall elements; said intermediate wall element including a main planar panel having opposed end edges, said edges having flange means thereon, said flange means defining shelf engaging slots located in coplanar relation relative to slots in said hinge means at one end thereof, and in coplanar relation to said self engaging slots in said flange means on at least one of said side wall elements; and at least one additional shelf element of width corresponding to the distance between a side wall element and said intermediate wall element engaged within said coplanar slots in said last mentioned elements.

3. The improvements set forth in claim 2, further characterized in said intermediate wall element having flange means on either side thereof, each defining self engaging slots, and at least one additional shelf element, whereby shelf may be positioned between said side walls on either side of said intermediate wall element.

* * * * *